US010724326B2

(12) United States Patent
Krüger

(10) Patent No.: US 10,724,326 B2
(45) Date of Patent: Jul. 28, 2020

(54) DOWNHOLE REPAIRING SYSTEM AND METHOD OF USE

(71) Applicant: WELLTEC OILFIELD SOLUTIONS AG, Zug (CH)

(72) Inventor: Christian Krüger, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 14 days.

(21) Appl. No.: 16/211,905

(22) Filed: Dec. 6, 2018

(65) Prior Publication Data

US 2019/0178048 A1 Jun. 13, 2019

(30) Foreign Application Priority Data

Dec. 7, 2017 (EP) ..... 17206056

(51) Int. Cl.
*E21B 33/124* (2006.01)
*E21B 23/06* (2006.01)
*E21B 33/126* (2006.01)

(52) U.S. Cl.
CPC ..... *E21B 33/124* (2013.01); *E21B 23/06* (2013.01); *E21B 33/126* (2013.01)

(58) Field of Classification Search
CPC ..... E21B 33/124; E21B 33/126; E21B 23/06
See application file for complete search history.

(56) References Cited

U.S. PATENT DOCUMENTS 9,745,819 B2 * 8/2017 Hallundbæk et al. ..... E21B 33/1208
10,428,617 B2 * 10/2019 Radtke ..... E21B 33/1292
2013/0220640 A1 8/2013 Fripp et al.

FOREIGN PATENT DOCUMENTS

GB 2463400 3/2010
WO 2007/140820 12/2007

OTHER PUBLICATIONS

Extended Search Report for EP17206056.8, dated Jun. 5, 2018, 7 pages.
DS Dressen, "SPE 2285: Analytical and Experimental Evaluation of Expanded Metal Packers for Well Completion Service", SPE91, Aug. 9, 1991, pp. 1-9.

* cited by examiner

*Primary Examiner* — David J Bagnell
*Assistant Examiner* — Yanick A Akaragwe
(74) *Attorney, Agent, or Firm* — Nixon & Vanderhye P.C.

(57) ABSTRACT

A downhole repairing system includes a downhole straddle assembly for straddling over a zone downhole in the well having a plurality of tubular sections. A downhole setting tool string has a tubular tool part with expansion openings for allowing pressurised fluid to flow out to expand expandable metal sleeves. The first end tubular section has a groove for receiving at least one retractable engagement part of a connection tool of the downhole setting tool string, and the second outer tool diameter is smaller than the second end inner diameter creating a first sealed distance which is less than 2 mm.

16 Claims, 16 Drawing Sheets

DOWNHOLE REPAIRING SYSTEM AND METHOD OF USE

Figure 1:
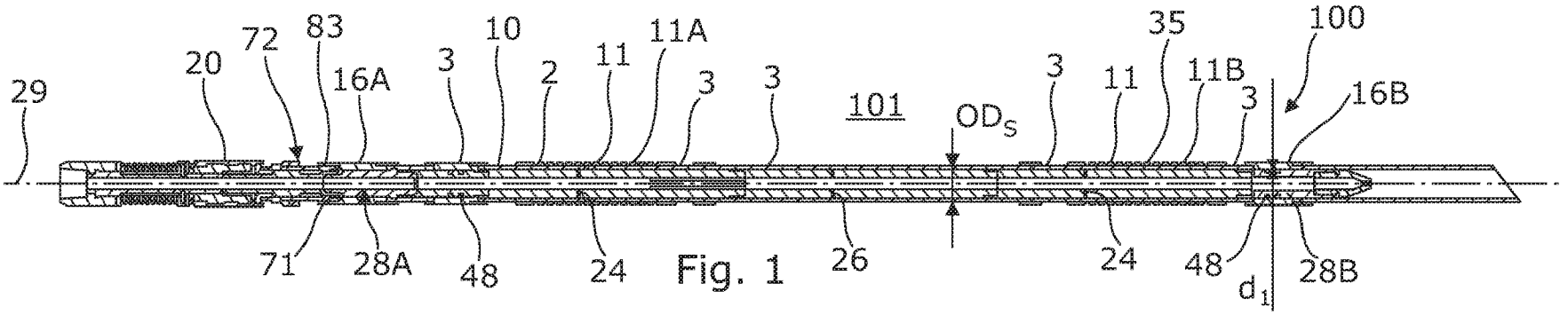

This application and claims priority to EP Patent Application No. 17206056.8 filed 7 Dec. 2017, the entire contents of which is hereby incorporated by reference.

The present invention relates to downhole repairing system for repairing a zone of a downhole well. Furthermore, the present invention relates to a repairing method for straddling over a zone, which is a collapsed part of a borehole, a damaged production zone or a water producing zone.

When a zone is damaged or is producing too much water, the zone needs to be sealed off. However, known solutions are challenged when it comes to isolating zones which are longer than 100 metres, as expansion of a patch assembly mounted from several tubulars in order to be able to cover the entire zone cannot provide proper sealing, since the tubulars have shown to separate during such expansion. Another known solution is to insert a new production tubing in the existing production tubing. However, inserting a new production tubing reduces the inner diameter and thus the flow area substantially and hence deteriorates the production. Furthermore, the inner diameter in the small diameter wells may be reduced to an extent where further intervention is no longer possible.

The problem associated with all known solutions is either that the length which the solutions are able to isolate is insufficient to isolate the entire zone or the inner diameter of the production tubing is reduced too much. There is therefore a need for a solution capable of isolating a zone which is longer than 50 metres, and which reduces the inner diameter less than the known solutions while still providing a reliable solution so that the intended zone isolation/separation is obtained.

Furthermore, when setting a straddle assembly, releasing the setting tool has proved to be difficult, and there is therefore a need for a simpler downhole repairing system which is able to isolate a zone sufficiently in a rapid manner without the risk of a setting tool getting stuck and/or the straddle assembly being damaged.

It is an object of the present invention to wholly or partly overcome the above disadvantages and drawbacks of the prior art. More specifically, it is an object to provide an improved downhole repairing system facilitating the setting of a straddle assembly downhole in an expedient and reliable manner.

The above objects, together with numerous other objects, advantages and features, which will become evident from the below description, are accomplished by a solution in accordance with the present invention by a downhole repairing system for repairing a zone of a downhole well having a top and an axial axis, comprising:

a downhole straddle assembly for straddling over the zone downhole in the well, the straddle assembly comprising:

a plurality of tubular sections mounted end to end in succession to form one tubular pipe having a first end tubular section nearest the top forming a first open end of the tubular pipe, and a second end tubular section forming a second open end of the tubular pipe, the first end tubular section having a first end inner diameter and the second end tubular section having a second end inner diameter, wherein the tubular section mounted to the first end tubular section is a first expandable metal sleeve being more pliant than the first end tubular section, and the tubular section mounted with the second end tubular section is a second expandable metal sleeve being more pliant than the second end tubular section, and a downhole setting tool string comprising a tubular tool part being arranged in the tubular pipe of the downhole straddle assembly and having expansion openings for allowing pressurised fluid from the downhole setting tool string to flow out of the expansion openings to expand the expandable metal sleeves, the tubular tool part having a first tool part with a first outer tool diameter arranged opposite the first end tubular section and a second tool part with a second outer tool diameter arranged opposite the second end tubular section, wherein the first end tubular section has a groove for receiving at least one retractable engagement part of a connection tool of the downhole setting tool string, and the second outer tool diameter is smaller than the second end inner diameter creating a first distance which is less than 2 mm, and wherein at least one sealing element is arranged in the distance.

Further, the downhole straddle assembly may be suspended from the downhole setting tool string.

Moreover, the first distance may be less than 1.5 mm, preferably less than 2 mm.

Additionally, the downhole setting tool string extends into the downhole straddle assembly from the first end tubular section to the second end tubular section.

Furthermore, the downhole setting tool string may be fastened only in the first end tubular section of the downhole straddle assembly.

The connection tool may mechanically lock the first end tubular section along the axial axis.

Moreover, the connection tool may comprise a mandrel for providing a radial force outwardly on the at least one retractable engagement part.

Further, the at least one retractable engagement part may be retracted by means of the pressurised fluid.

Also, the at least one retractable engagement part may be connected with a piston sleeve which is moved upwards or downwards along the axial axis to disengage the at least one retractable engagement part from the first end tubular section.

In addition, the mandrel may be moved to be offset in relation to the at least one retractable engagement part, so that the at least one retractable engagement part can move radially inwards and disengage from the first end tubular section.

The connection tool may be a standard connection tool such as a GS tool or a running tool.

Furthermore, the connection tool may comprise a breakable element, such as a shear pin, for maintaining the at least one retractable engagement part in engagement with the groove until a predetermined force is reached, e.g. an axial pulling or pushing force provided on the downhole setting tool string or from a certain fluid pressure of the pressurised fluid.

Also, the at least one retractable engagement part may be a dog, a pawl or an arm.

Additionally, the at least one retractable engagement part may be an expandable/inflatable element.

The second tool part may have a one-way valve allowing fluid from the well to enter the downhole setting tool string and preventing fluid from the downhole setting tool string from entering the well.

Moreover, the second tool part may be closable by means of a ball being dropped into the tubular tool part.

Further, the first outer tool diameter may be smaller than the first end inner diameter, creating a second distance which is less than 4 mm and/or equal to the first distance, and wherein at least one sealing means is arranged in the second distance.

In addition, the downhole setting tool string may comprise coiled tubing, a workover pipe or a drill pipe connected to the connection tool for providing pressurised fluid to expand the expandable metal sleeves.

Also, the downhole setting tool string may comprise a pump and a motor for driving the pump, the motor being powered through a wireline, so that the downhole setting tool string is a wireline setting tool string.

The downhole straddle assembly may only be mechanically locked along the axial axis at the first end tubular section. Hereby, it will be easy to disconnect and will hence not get stuck.

The present invention also relates to a repairing method for straddling over a zone which is a collapsed part of a borehole, a damaged production zone or a water producing zone, the method comprising:

- providing the downhole repairing system according to any of the preceding claims,
- inserting the downhole repairing system into a borehole or a well tubular metal structure,
- providing the downhole repairing system opposite the zone to be sealed off,
- closing the second tool part,
- pressurising the inside of the tubular tool part,
- expanding the expandable metal sleeves on either sides of the zone,
- disconnecting the at least one retractable engagement part from the groove, and
- pulling the tool string out of the well.

In the repairing method according to the present invention, providing the downhole repairing system may comprise arranging the tool string inside the downhole straddle assembly, and engaging the at least one retractable engagement part with the groove of the first end tubular section.

Also, in the repairing method according to the present invention, engaging the at least one retractable engagement part with the groove may be performed by moving the mandrel to be opposite the at least one retractable engagement part, so that the mandrel pushes the at least one retractable engagement part radially outwards.

Further, in the repairing method according to the present invention, disconnecting the at least one retractable engagement part from the groove may be performed by increasing the pressure inside the tool string to break a breakable element, such as a shear pin.

Moreover, the expandable metal sleeves may be more pliant than the other tubular sections.

Additionally, the expandable metal sleeve may have an outer sleeve diameter in an unexpanded state, the outer sleeve diameter being equal to or smaller than the outer diameter of the other tubular sections forming the tubular pipe.

Also, the expandable metal sleeve may have an inner sleeve diameter being equal to or larger than an inner diameter of the other tubular sections forming the tubular pipe.

Furthermore, the expandable metal sleeves may be expanded by an internal fluid pressure in the tubular pipe.

Further, the ends of the expandable metal sleeve may be welded to other tubular sections forming the tubular pipe.

In addition, the expandable metal sleeve may have a thickness which is smaller than a part thickness of the other tubular sections forming the tubular pipe.

Additionally, the expandable metal sleeve may have a first end and a second end at least partly overlapping the ends of the adjacent tubular sections forming the tubular pipe.

Also, a plurality of tubular sections may be arranged between the expandable metal sleeves.

Furthermore, at least one of the tubular sections between the expandable metal sleeves may comprise an inflow section, a sensor section or a gas lift valve.

The inflow section may comprise a screen.

Moreover, the straddle assembly may have an inner straddle face forming a flow path in the straddle assembly.

Further, the expandable metal sleeve may have an inner sleeve face forming part of the inner straddle face.

The downhole straddle assembly may further comprise:

- a first end part having a first end connected to the first end of the expandable metal sleeve and a second end for being mounted as part of the tubular pipe, and
- the second end part having a first end connected to the second end of the expandable metal sleeve and a second end for being mounted as part of the tubular pipe, wherein the first end of the first end part is connected end to end to the first end of the expandable metal sleeve, and the first end of the second end part is connected end to end to the second end of the expandable metal sleeve, and wherein the second ends of the end parts are provided with male or female thread connections for being mounted to corresponding male or female thread connections of the tubular pipe.

Said first and second end parts may be connected to the first and second ends of the expandable metal sleeve by means of a standard connection, such as a stub acme thread connection.

Moreover, the expandable metal sleeve may have:

- a first section having a first outer diameter and a first thickness, and
- at least two circumferential projections having a thickness which is larger than a first thickness and having a second outer diameter which is larger than the first outer diameter, so that when expanding the expandable metal sleeve, the first section bulges more radially outwards than the first section, resulting in the expandable metal sleeve being strengthened.

Also, the expandable metal sleeve may have a length, with no tubular being arranged within the expandable metal sleeve along the entire length of the expandable metal sleeve.

The zone may be a collapsed part of the borehole, production zone, water producing zone, valve(s) or opening (s) in the well tubular metal structure.

Further, the tool string may be configured to pressurise a part of the straddle assembly.

The well may comprise a borehole having a wall.

Moreover, the well may comprise a well tubular metal structure having a wall having an inner face, the well tubular metal structure being arranged in the borehole.

Also, an outer face of the expandable metal sleeve may face the wall of the borehole and may be configured to abut the wall of the borehole or the well tubular metal structure after expansion.

The present invention also relates to a downhole repairing method for straddling over a zone which is at least 50 metres long.

Figure 2:
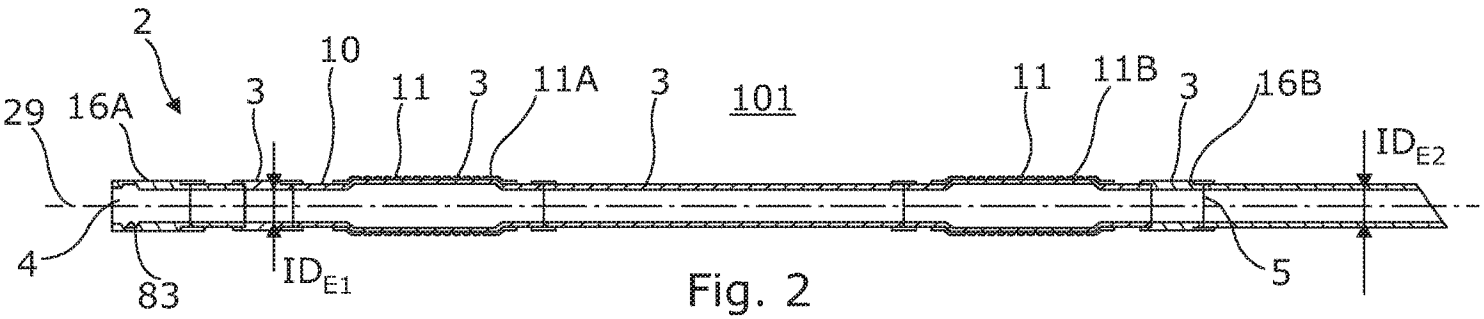
Figure 3:
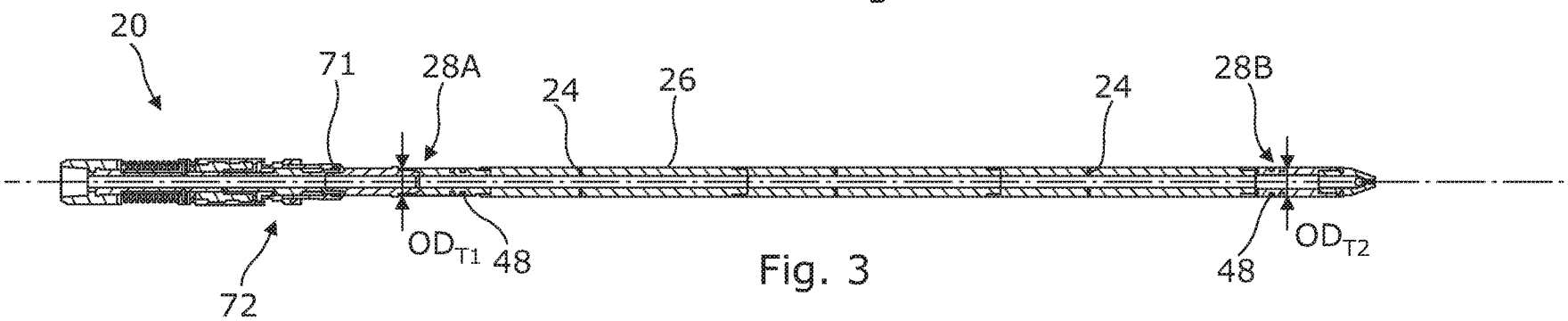
Figure 4:
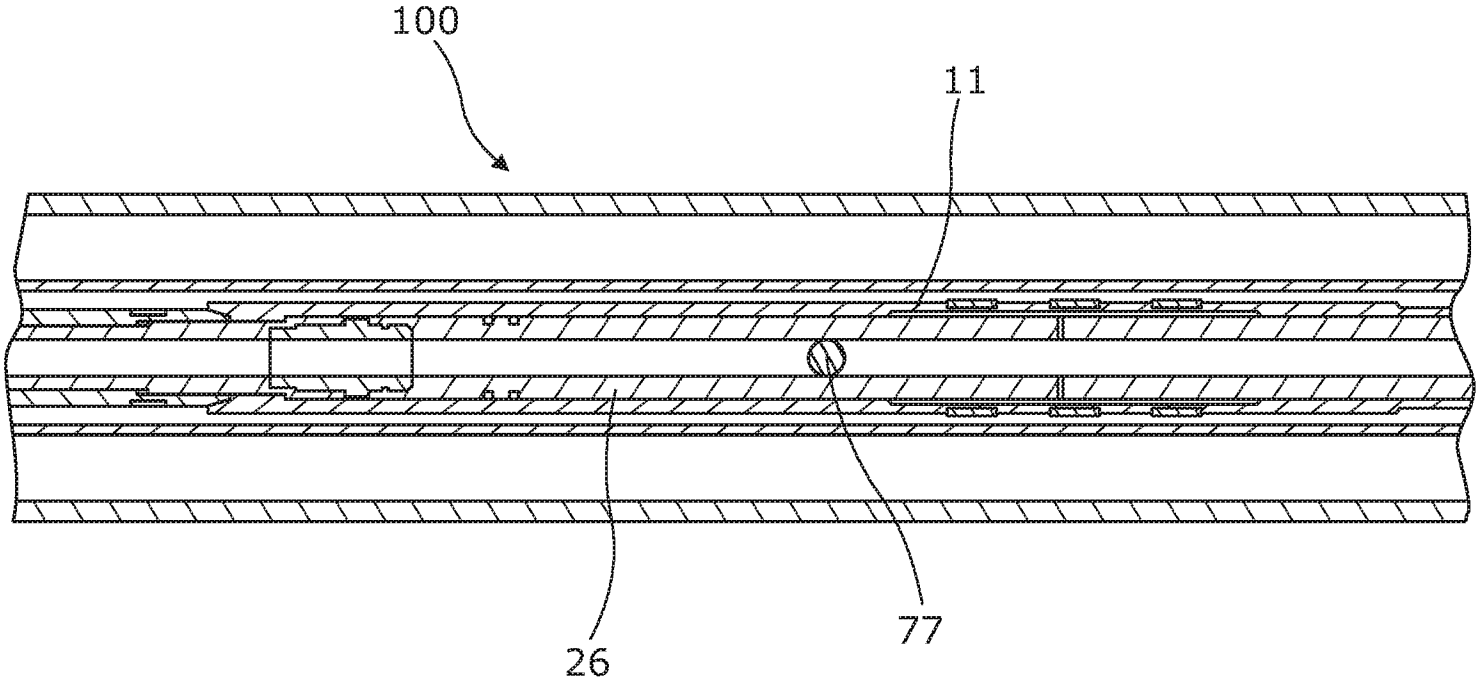
Figure 5:
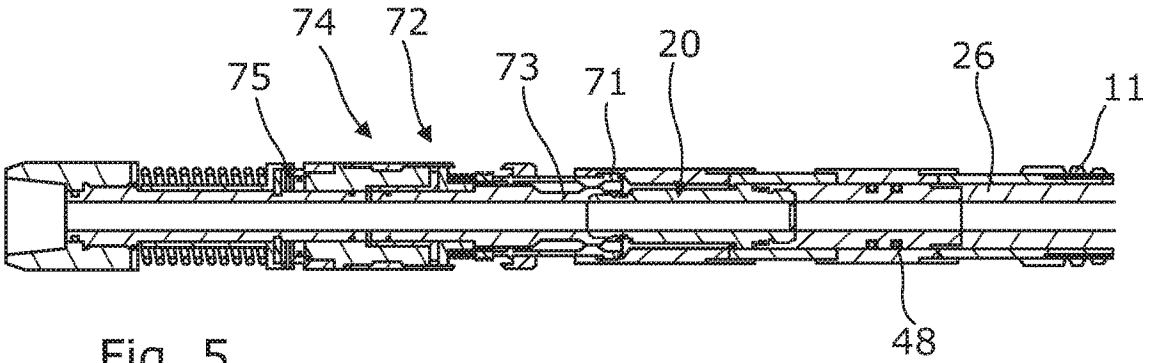
Figure 6:
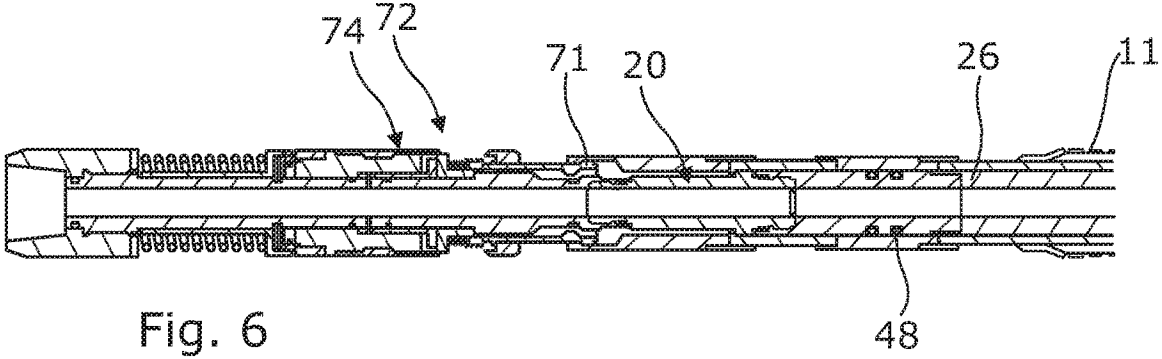
Figure 7:
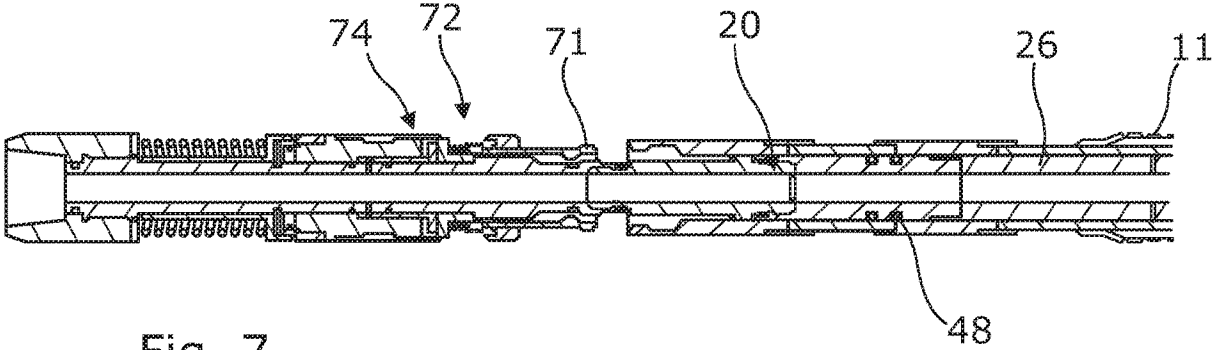
Figure 8:
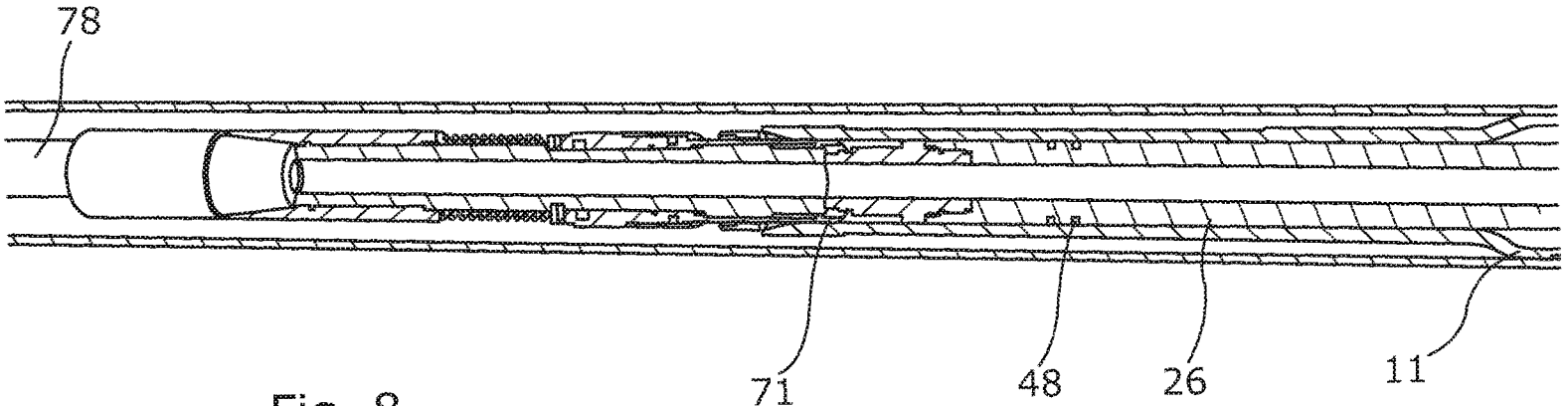
Figure 9:
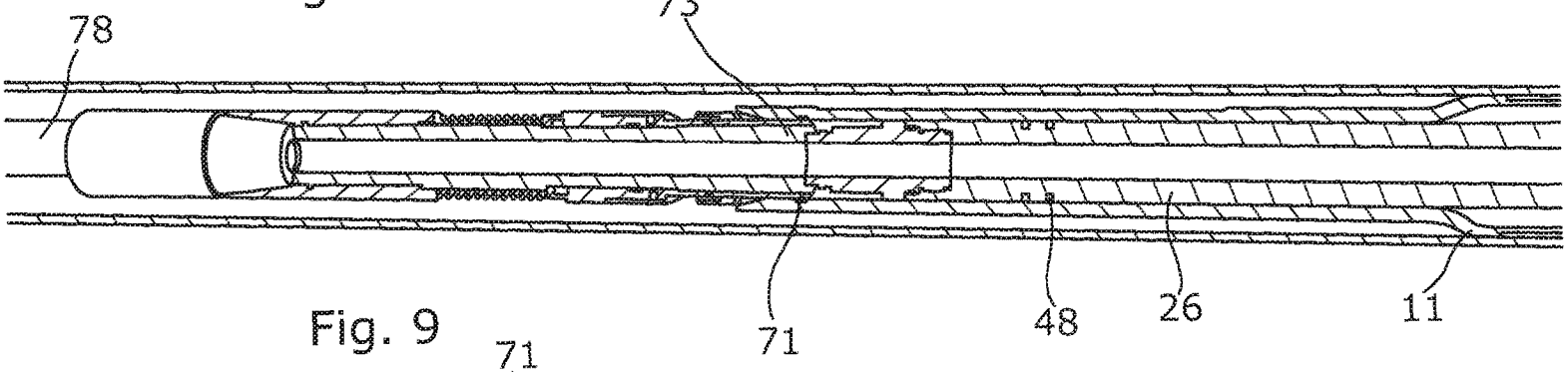
Figure 10:
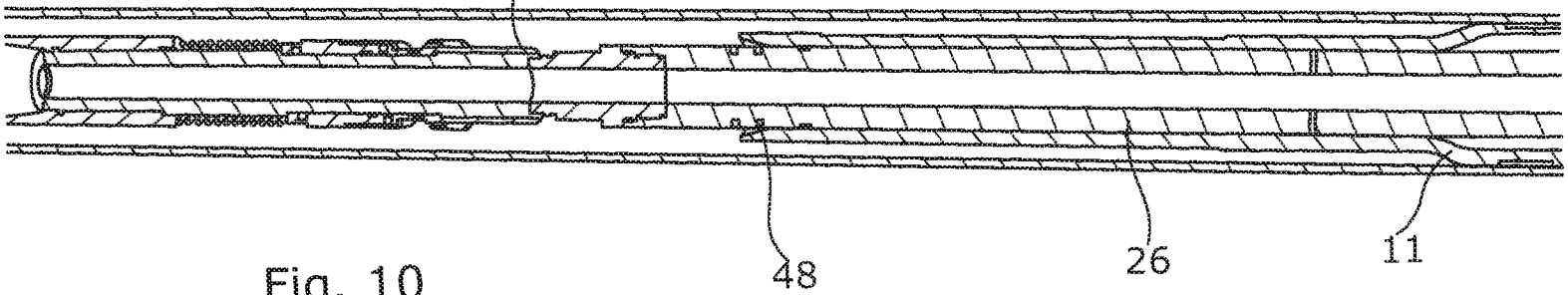
Figure 11:
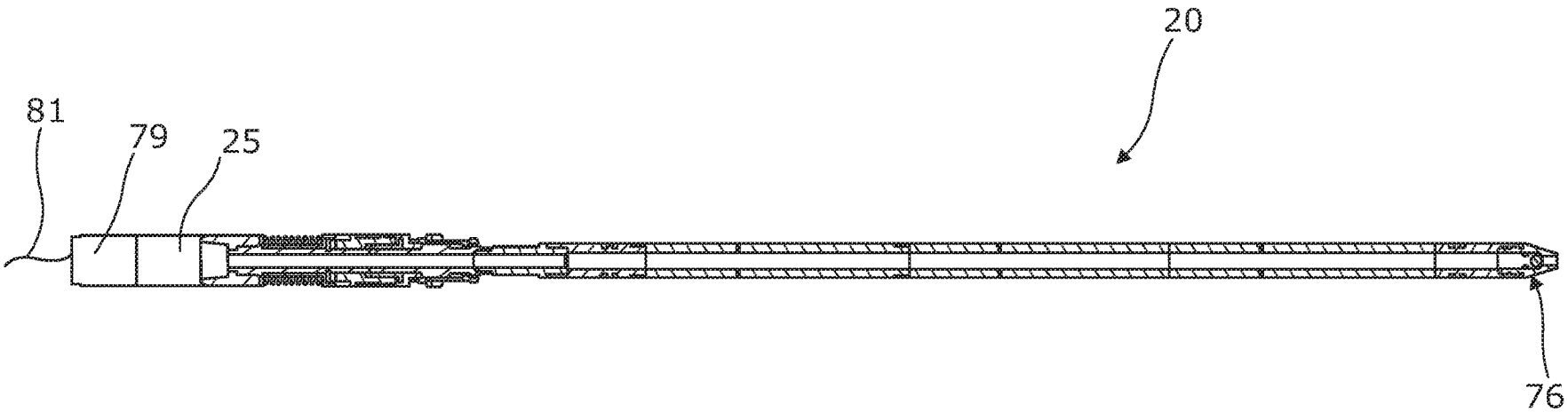
Figure 12:
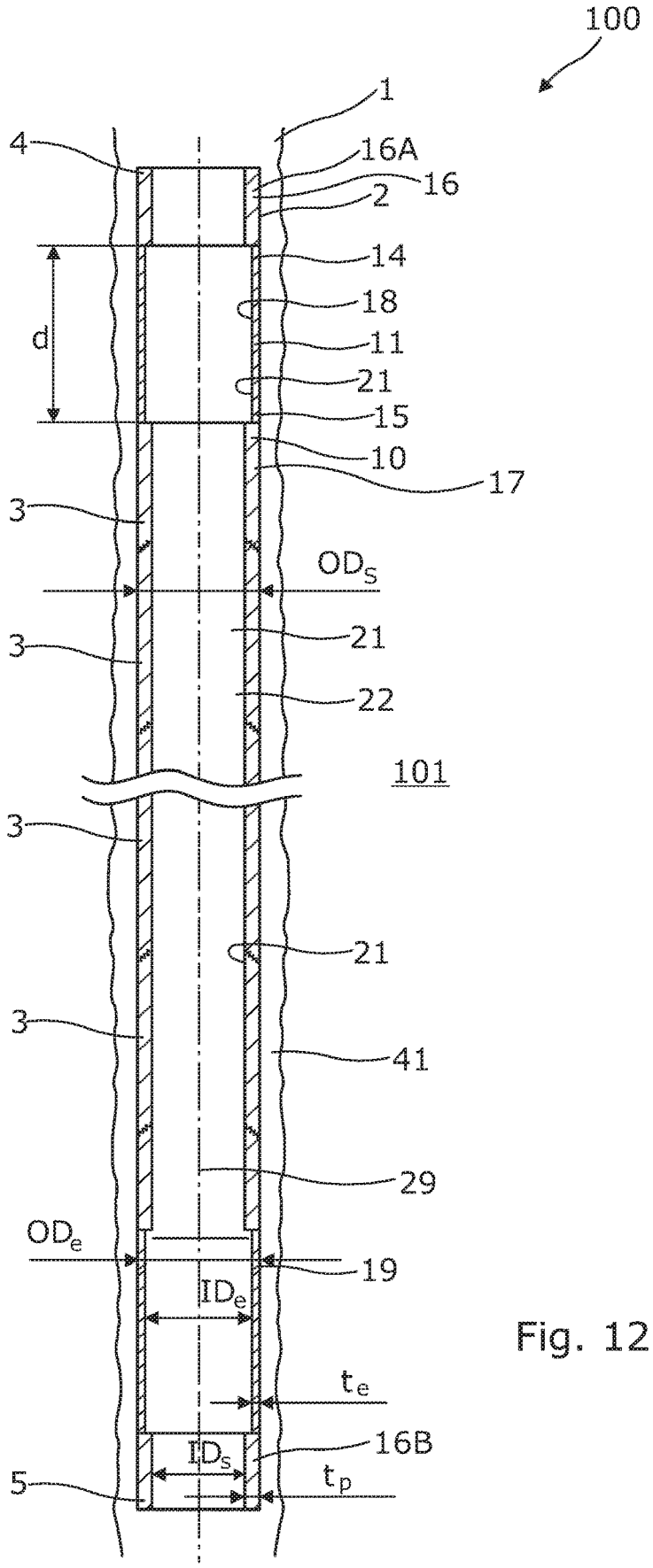
Figure 13:
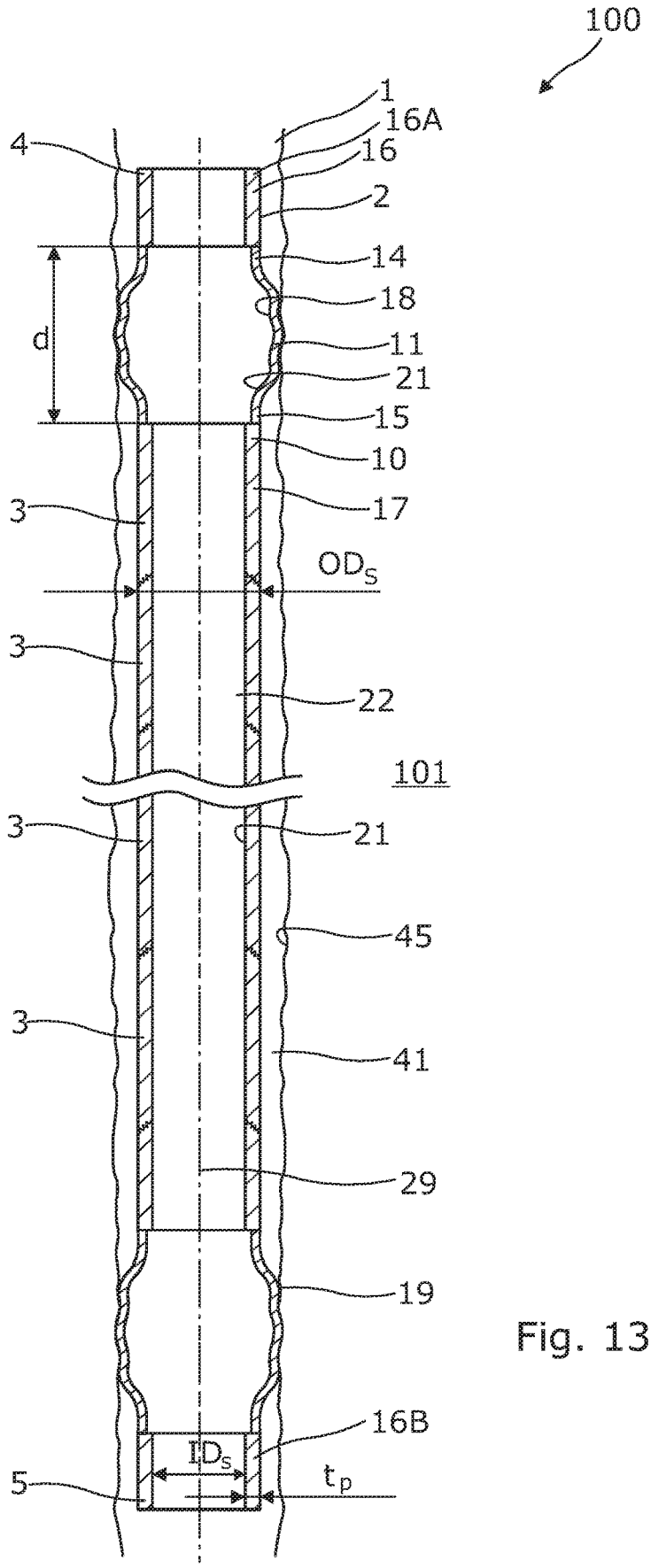
Figure 14:
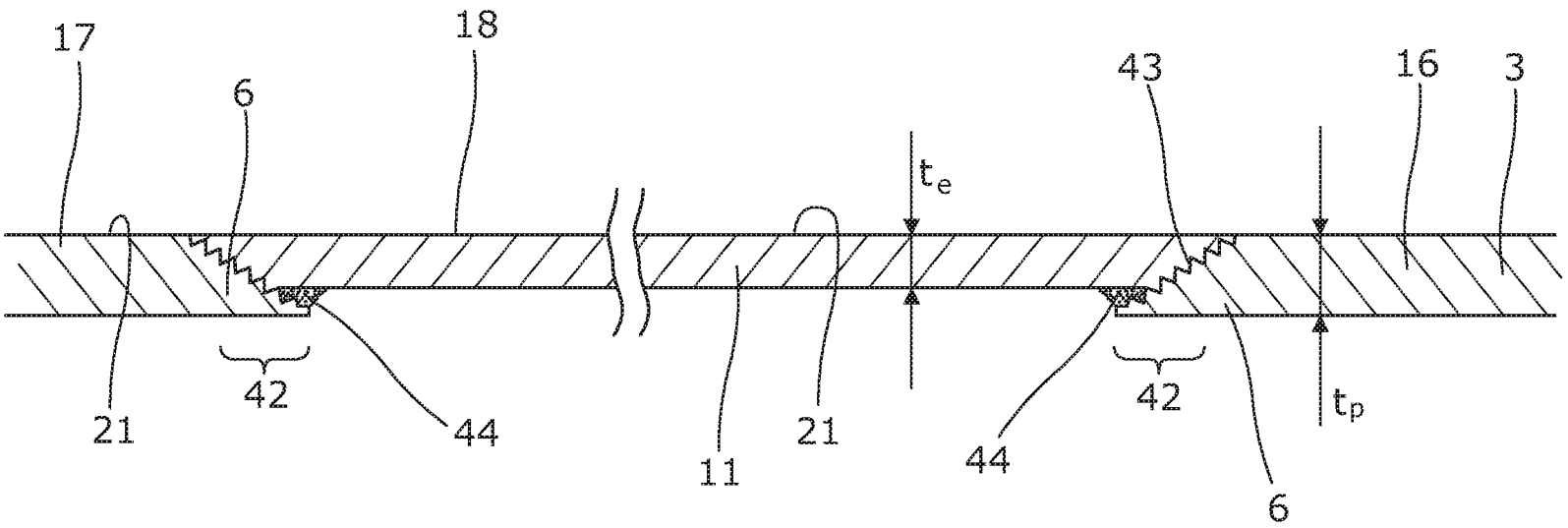
Figure 15:
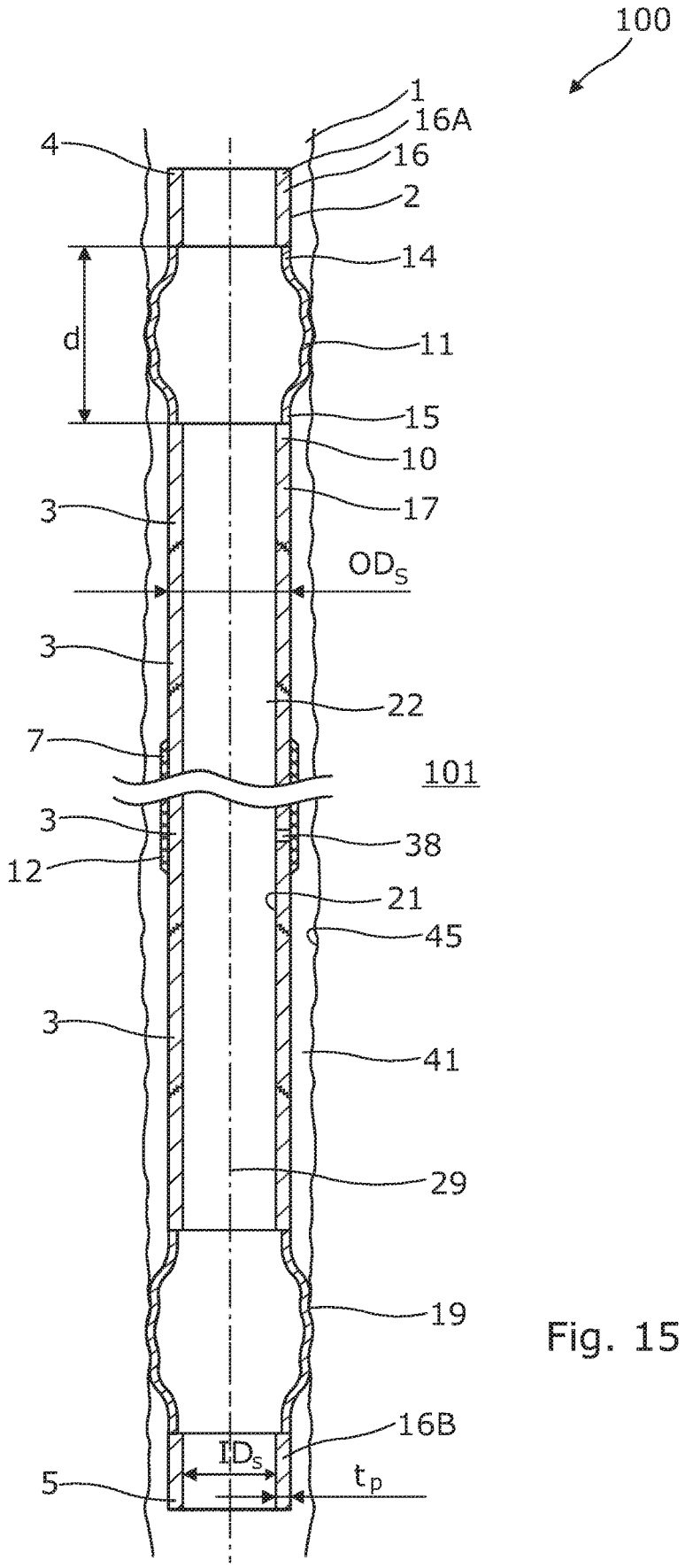
Figure 16:
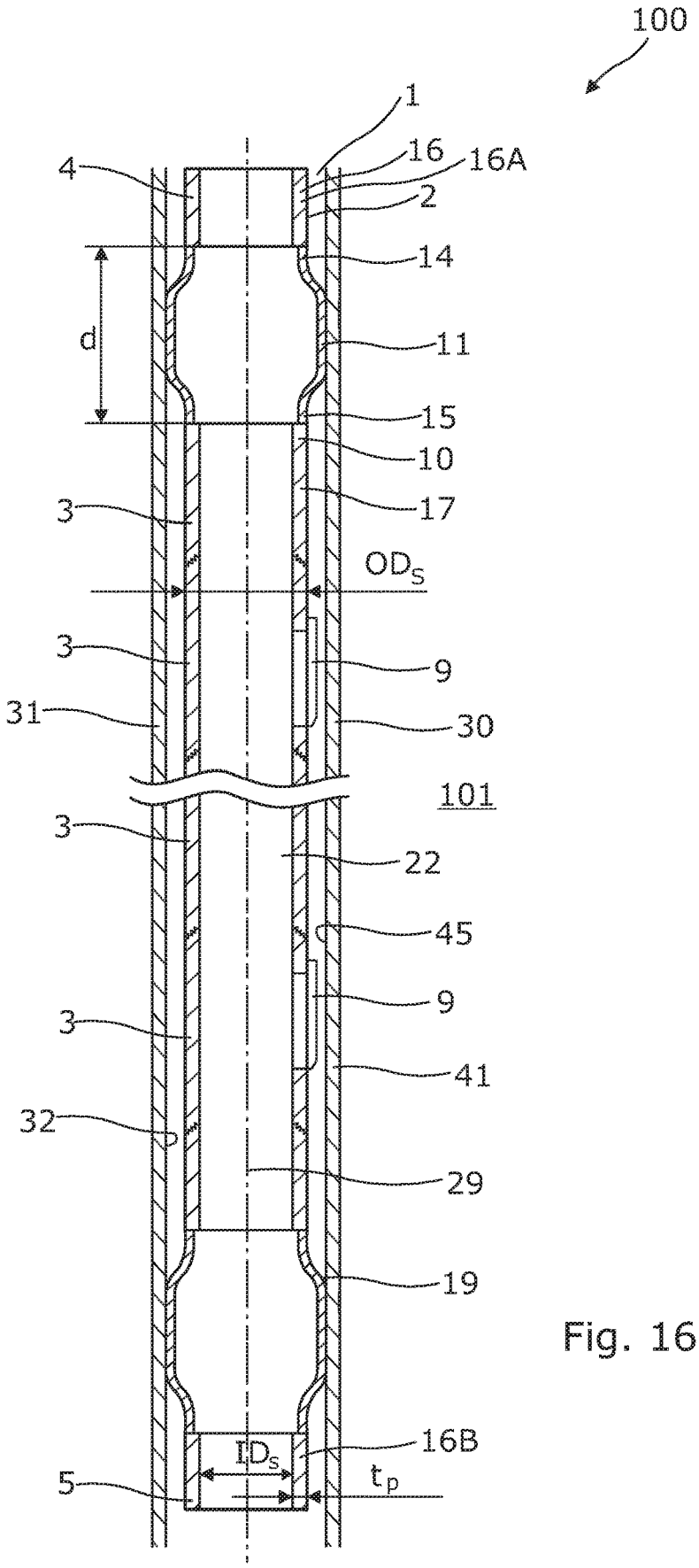
Figure 17:
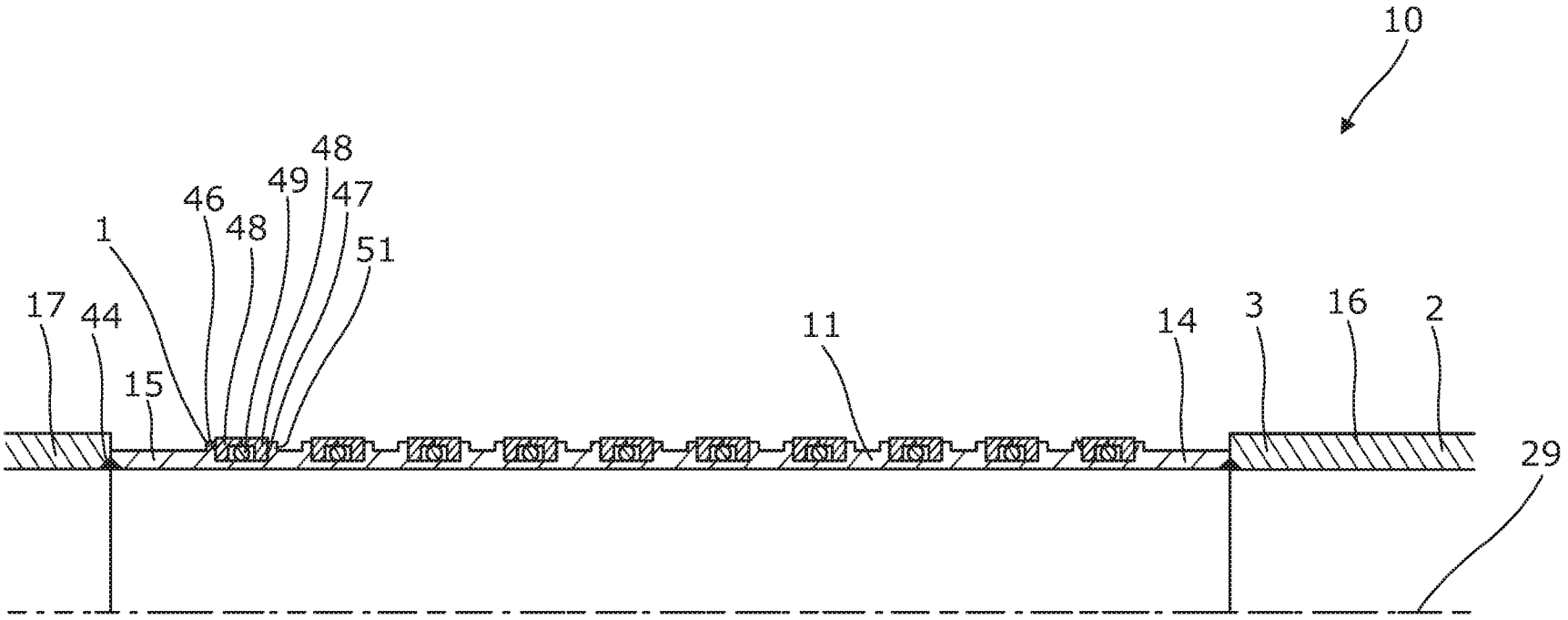
Figure 18:
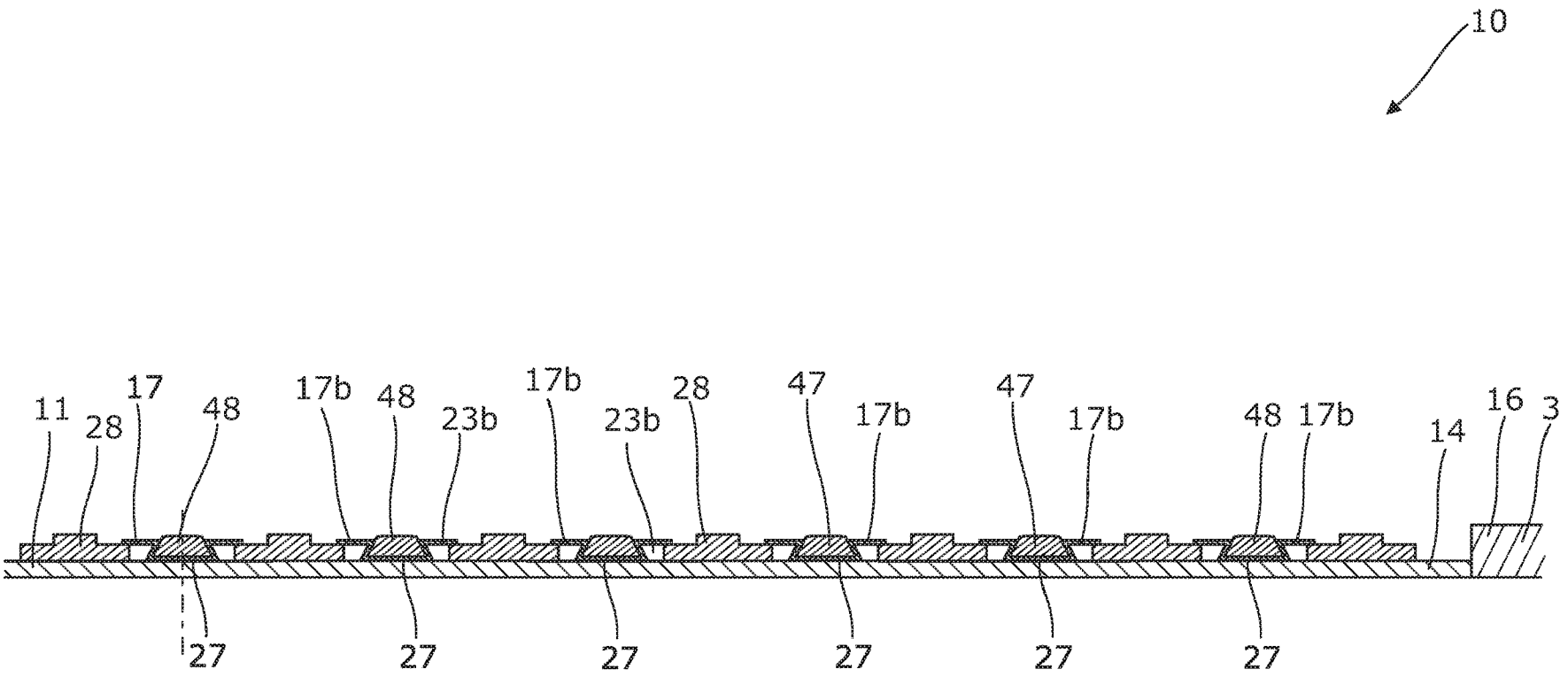
Figure 19:
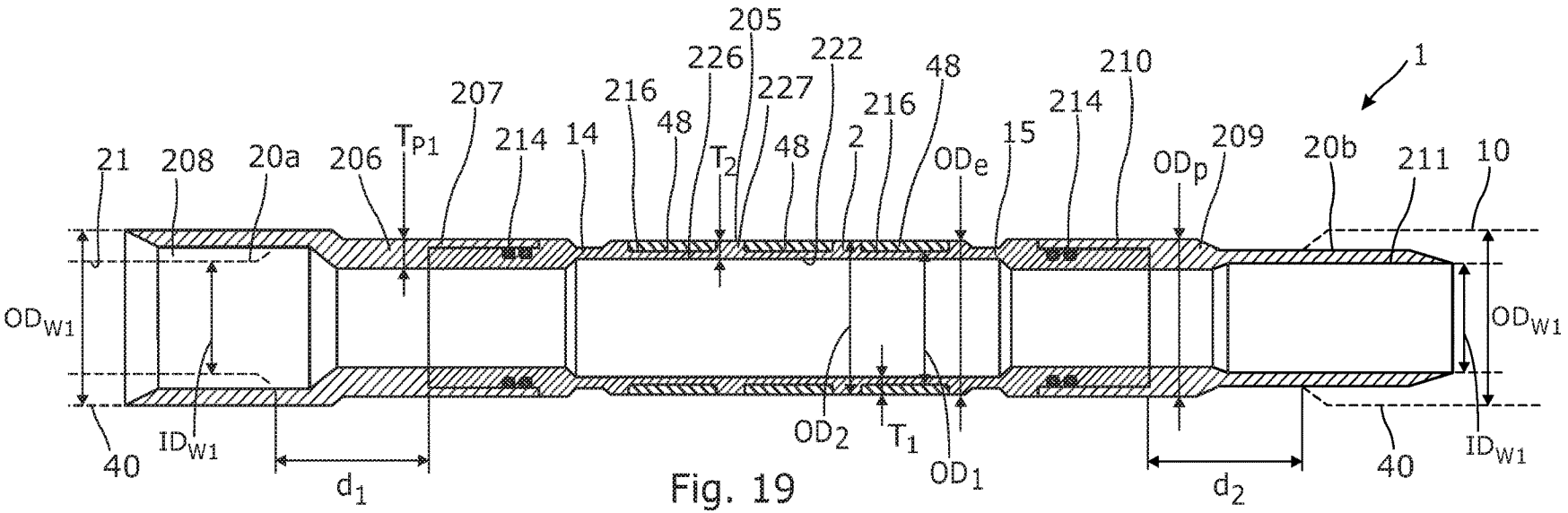
Figure 20:
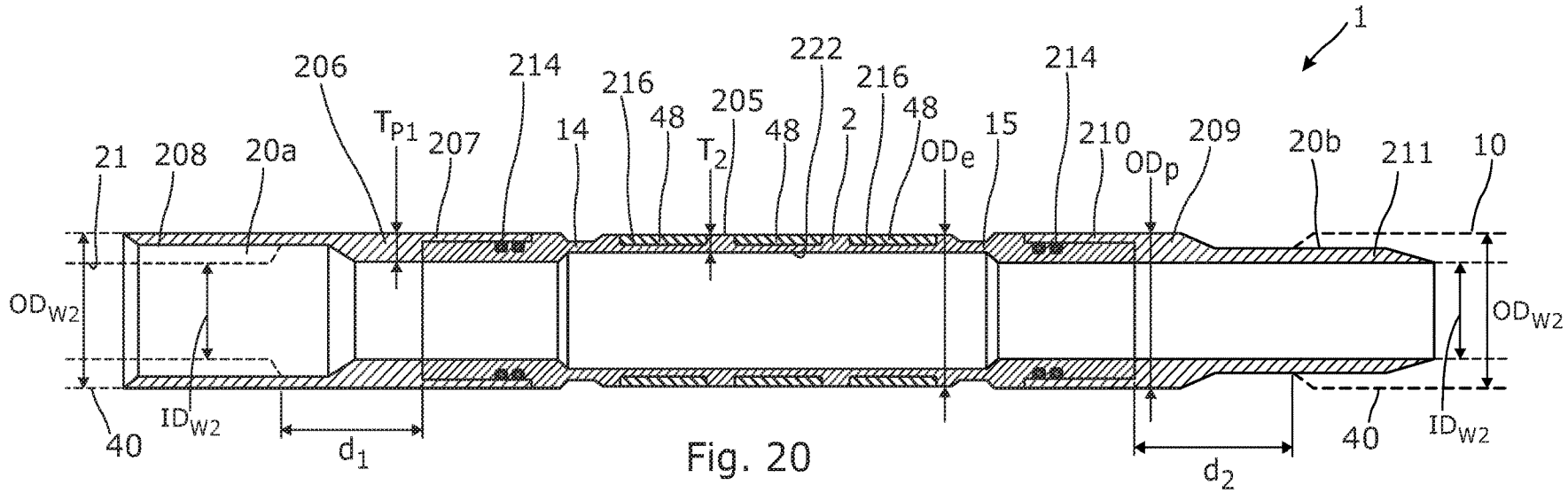
Figure 21:
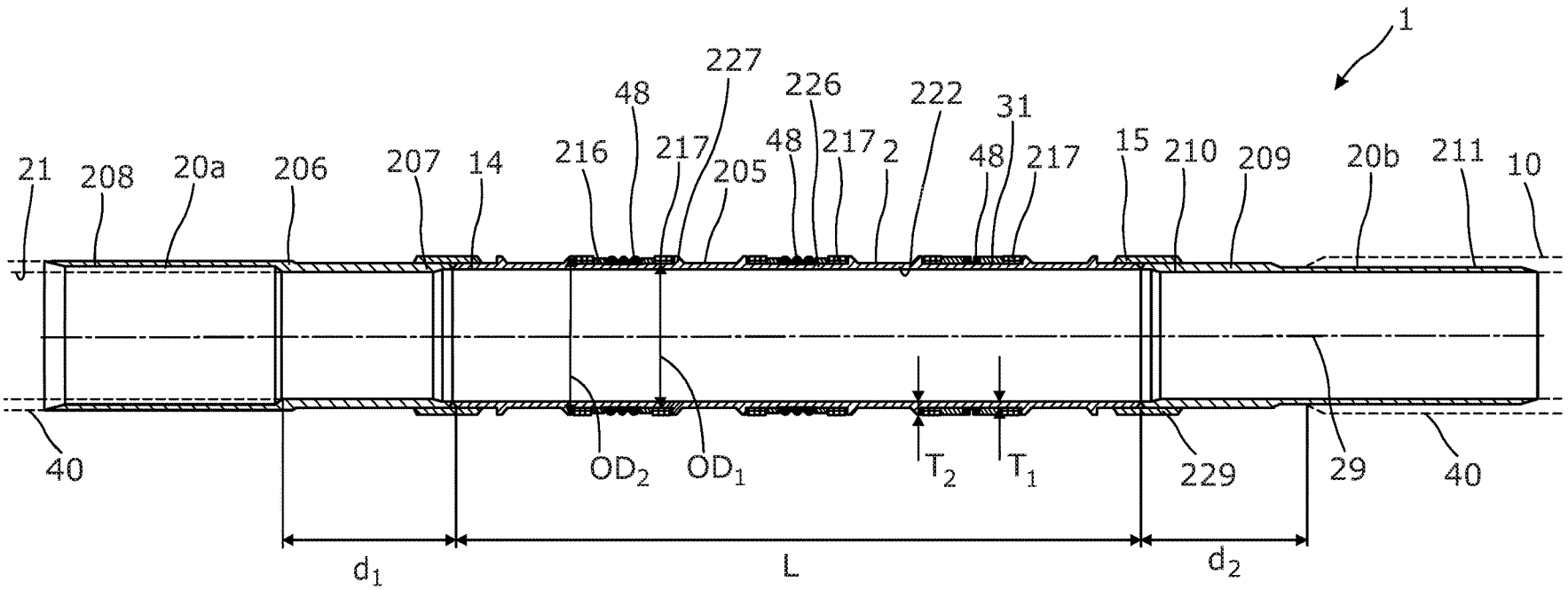
Figure 22:
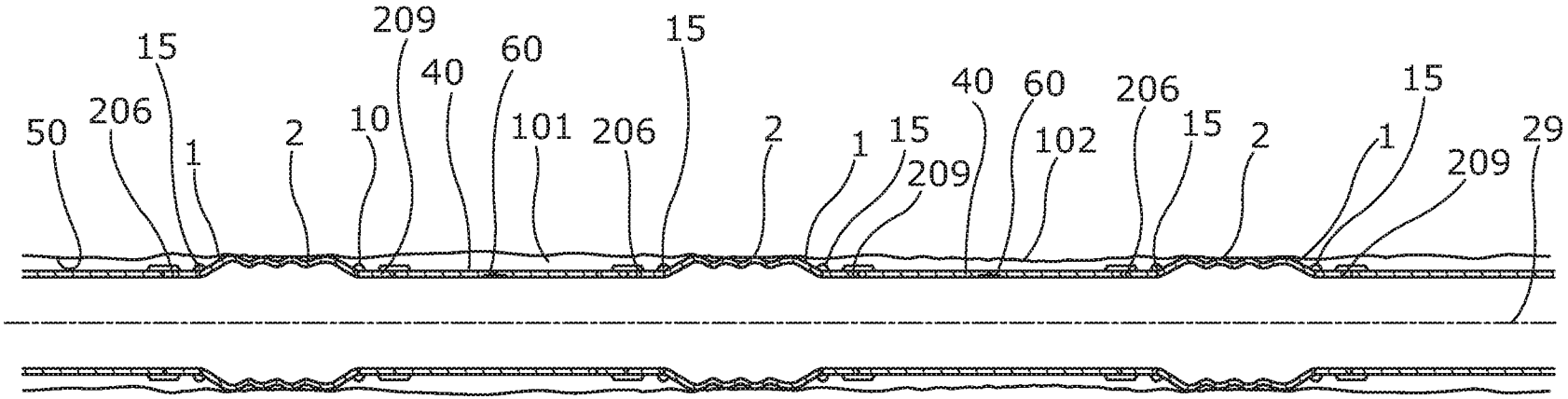
Figure 23:
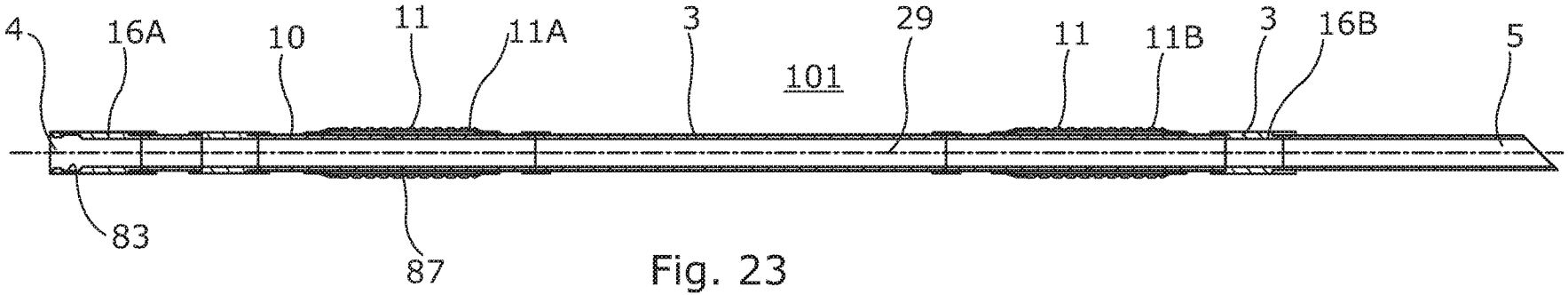

The invention and its many advantages will be described in more detail below with reference to the accompanying schematic drawings, which for the purpose of illustration show some non-limiting embodiments and in which:

FIG. 1 shows a cross-sectional view of a downhole repairing system having a downhole setting tool string in a downhole straddle assembly ready for insertion in a well for straddling over a damaged zone, FIG. 2 shows a cross-sectional view of the downhole straddle assembly of FIG. 1 in its expanded condition, FIG. 3 shows a cross-sectional view of the downhole setting tool string of FIG. 1, FIG. 4 shows a cross-sectional view of another downhole repairing system, FIG. 5 shows a cross-sectional view of a connection tool of the downhole setting tool string of FIG. 1 in an engaged position, FIG. 6 shows a cross-sectional view of the connection tool of FIG. 5 in an intermediate position, in which the retractable engagement part is free to move radially inwards, FIG. 7 shows a cross-sectional view of the connection tool of FIG. 5 in a disengaged position, FIG. 8 shows a cross-sectional view of the downhole repairing system of FIG. 4 during pressurising the tubular pipe and expanding the expandable metal sleeve and in which condition the retractable engagement part is in its engaged position, FIG. 9 shows a cross-sectional view of the downhole repairing system of FIG. 4 in which the retractable engagement part is in its disengaged position, FIG. 10 shows a cross-sectional view of the downhole repairing system of FIG. 4 in which the downhole setting tool string is being pulled out of the well, FIG. 11 shows a cross-sectional view of another downhole repairing system having a wireline setting tool string, FIG. 12 shows a cross-sectional view of a downhole straddle assembly, in an un-set condition, for straddling over a zone downhole, FIG. 13 shows a cross-sectional view of the downhole straddle assembly of FIG. 1 in an expanded and set condition, FIG. 14 shows a cross-sectional view of part of another downhole straddle assembly, FIG. 15 shows a cross-sectional view of another downhole straddle assembly having a screen, FIG. 16 shows a cross-sectional view of another downhole straddle assembly having gas lift valves, FIG. 17 shows a cross-sectional view of an expandable metal sleeve of the annular barrier sections comprising a sealing arrangement, FIG. 18 shows a cross-sectional view of another expandable metal sleeve of the annular barrier sections comprising another sealing arrangement, FIG. 19 shows a cross-sectional view of a tubular section having an expandable metal sleeve for mounting as part of tubular pipe of a downhole straddle assembly in a small diameter borehole, FIG. 20 shows a cross-sectional view of a tubular section having an expandable metal sleeve for mounting as part of a tubular pipe in a small diameter borehole, FIG. 21 shows a cross-sectional view of yet another tubular section having an expandable metal sleeve for mounting as part of a tubular pipe in a small diameter borehole, FIG. 22 shows a downhole straddle assembly having several expandable metal sleeves for straddling over a damaged zone, and FIG. 23 shows a cross-sectional view of a downhole straddle system further comprises a base pipe.

All the figures are highly schematic and not necessarily to scale, and they show only those parts which are necessary in order to elucidate the invention, other parts being omitted or merely suggested.

FIG. 1 shows a downhole repairing system 100 for repairing a zone 101 of a downhole well 1 which is e.g. damaged or producing too much water. The well extends from a top 110 along an axial axis 29 of a borehole being partly or fully cased. The downhole repairing system 100 comprises a downhole straddle assembly 2 for straddling over the zone 101 downhole in the well 1. The downhole straddle assembly 2 comprises a plurality of tubular sections 3 mounted end to end in succession to form one tubular pipe 10 having a first end tubular section 16A nearest the top forming a first open end 4 of the tubular pipe. The downhole straddle assembly 2 has a second end tubular section 16B forming a second open end 5 of the tubular pipe. The first end tubular section 16A has a first end inner diameter $ID_{E1}$ and the second end tubular section 16B has a second end inner diameter $ID_{E2}$. In FIG. 1, the first end inner diameter $ID_{E1}$ is substantially equal to the second end inner diameter $ID_{E2}$. The tubular section mounted to the first end tubular section (nearest the top) is a first expandable metal sleeve 11, 11A being more pliant than the first end tubular section. The tubular section mounted with the second end tubular section is a second expandable metal sleeve 11, 11B being more pliant than the second end tubular section. The downhole repairing system 100 further comprises a downhole setting tool string 20 comprising a tubular tool part 26 being arranged in the tubular pipe of the downhole straddle assembly 2. The tubular tool part 26 has expansion openings 24 for allowing pressurised fluid from inside the downhole setting tool string out of the expansion openings to expand the expandable metal sleeves 11. The tubular tool part 26 has a first tool part 28A with a first outer tool diameter $OD_{T1}$ arranged opposite the first end tubular section 16A and a second tool part 28B with a second outer tool diameter $OD_{T2}$ arranged opposite the second end tubular section 16B. The first end tubular section 16A has a groove 83 for receiving at least one retractable engagement part 71 of a connection tool 72 of the downhole setting tool string. In this way, the downhole straddle assembly 2 is locked along the axial axis when the downhole straddle assembly 2 is suspended from the downhole setting tool string. At the second tool part 28B, the second outer tool diameter is smaller than the second end inner diameter, creating a first distance $d_1$ which is less than 2 mm, and wherein at least one sealing element 48 is arranged in the distance.

By having such small distance, a simple seal can be provided between the tool string and the straddle assembly at the second end tubular section, and the seal provides an annular space 35 between the tool string and the assembly, which annular space can be pressurised. The annular space 35 is in fluid communication with the inside of the tool string via the openings 24 and by pressurising the tool string the annular space is pressurised and thereby expanding the expandable metal sleeves 11 in a simple manner and with a simple tool string design.

The downhole setting tool string 20 of FIGS. 1 and 3 is only connected to the downhole straddle assembly 2 at the first end tubular section 16A for taking up axial load from the downhole straddle assembly 2. In the second end tubular section 16B, the downhole setting tool string 20 of FIG. 3 is only in a sealing relation to the downhole straddle assembly and takes up no axial load from the assembly and can therefore not get stuck as in prior art solutions. Thus, the tool string, when disengaging the groove 83 of the assembly, can easily be retracted, and a standard connection tool can be used for such connection of the tool string to the straddle assembly. Therefore, the risk of the tool string getting stuck in the well is substantially reduced, since the tool string is not to be released in the second end of the straddle assembly furthest away from the top, and which second end is not accessible if something does not go according to plan.

As shown in FIG. 1, the connection tool 72 mechanically locks the first end tubular section along the axial axis. The connection tool comprises a mandrel 73 for providing a radial force outwardly on the at least one retractable engagement part to keep the retractable engagement part in engagement with the groove 83. The retractable engagement part may be retracted by means of the pressurised fluid in that the retractable engagement part is connected with a piston sleeve 74 which is moved upwards or downwards along the axial axis to disengage the retractable engagement part from the groove and thus the first end tubular section 16A. When moving the piston sleeve 74 by pressurised fluid after having expanded the expandable metal sleeve, e.g. to a pressure above the pressure needed for expanding the expandable metal sleeve, the retractable engagement part is moved away in the groove away from the mandrel.

In the downhole repairing system of FIG. 8, the mandrel 73 is opposite the retractable engagement part, and in FIG. 9 the mandrel is moved to be offset in relation to the retractable engagement part, so that the retractable engagement part can move radially inwards and disengage from the first end tubular section 16A as shown in FIG. 10. This may be performed by simply applying a downward force on the tool string.

In another embodiment, the mandrel may be moved by means of pressurised fluid by increasing the pressure after having expanded the expandable metal sleeves. The connection tool comprises a breakable element 75, such as a shear pin shown in FIG. 5, for maintaining the retractable engagement part in engagement with the groove 83 until a predetermined force is reached, e.g. from a certain fluid pressure of the pressurised fluid. Then the shear pin is sheared as shown in FIG. 6, and the retractable engagement part is in an intermediate position, in which the retractable engagement part is free to move radially inwards when pulling in the tool string as shown in FIG. 7, where the connection tool of the tool string is released from the downhole straddle assembly.

In another embodiment, the breakable element 75 may break by an axial pulling or pushing force provided on the downhole setting tool string, and then the retractable engagement part is free to move radially inwards and disengage the downhole straddle assembly.

The connection tool may be a standard connection tool, such as a GS tool as shown in FIG. 1, or a running tool. The retractable engagement part may be a dog, a pawl or an arm pivoting for moving radially inwards when disengaging. The retractable engagement part may also be an expandable/inflatable element which may be inflated by means of the pressurised fluid.

In FIG. 11, the second end tubular section 16B of the downhole repairing system 100 has a one-way valve 76 allowing fluid from the well to enter the downhole setting tool string and preventing fluid from the downhole setting tool string from entering the well. The downhole setting tool string comprises a pump 25 and a motor 79 for driving the pump, and the downhole setting tool string is connected to a wireline 81 for powering a motor driving the pump, and the downhole setting tool string is thus a wireline setting tool string.

In FIGS. 8-10, the downhole setting tool string is connected with tubing providing pressurised fluid from surface. The tubing may be coiled tubing 78, as shown, or workover pipe or drill pipe connected to the connection tool for providing pressurised fluid to expand the expandable metal sleeves.

The downhole setting tool string has flow-through while running in whole, so that the fluid in the well can flow through the downhole setting tool string.

As shown in FIG. 4, the second tool part may be closed by means of a ball 77 being dropped into the tubular tool part and flowing along the pressurised fluid to seat in the second end tubular section 16B, and then the tubular tool part can be pressurised to expand the expandable metal sleeves.

In FIG. 8, the first outer tool diameter is smaller than the first end inner diameter, creating a second distance $d_2$ which is less than 4 mm, preferably less than 2 mm, and in another embodiment equal to the first distance. Two sealing means 48B are arranged in the second distance for sealing the annular space 35 between the downhole straddle assembly 2 and the downhole setting tool string.

The zone 101 may need repairing if the zone is a collapsed part of the borehole, a non-producing production zone, a water producing zone, one or more valve(s) not functioning as intended or opening(s) in the well tubular metal structure which is/are worn. Repairing of such zone is performed by providing the above mentioned downhole repairing system, inserting the downhole repairing system into a borehole 41 or a well tubular metal structure 30, providing the downhole repairing system opposite the zone to be sealed off, and closing the second tool part 28B. Then the inside of the tubular tool part is pressurised, the expandable metal sleeves is expanded on either side of the zone, the at least one retractable engagement part is disconnected from the groove, and the tool string is pulled out of the well.

Providing the downhole repairing system comprises arranging the tool string inside the downhole straddle assembly, and engaging the at least one retractable engagement part with the groove of the first end tubular section 16A. Engaging the at least one retractable engagement part with the groove 83 is performed by moving the mandrel to be opposite the at least one retractable engagement part, so that the mandrel pushes the at least one retractable engagement part radially outwards. Engaging the at least one retractable engagement part with the groove is, in another embodiment, performed by moving the piston sleeve 74 being connected with the retractable engagement part along the axial axis and likewise disengage by moving the sleeve in the opposite direction. Disconnecting the retractable engagement part from the groove is performed by increasing the pressure inside the tool string to break a breakable element, such a shear pin, or by applying an axial force on the tool string.

As can be seen in FIG. 22, the expandable metal sleeve has a length L, and no tubular is arranged within the expandable metal sleeve 11 along the entire length of the expandable metal sleeve. In another embodiment shown in FIG. 23, the downhole straddle system further comprises a base pipe 87 being a tubular section mounted as part of the tubular pipe 10, and around which base pipe the expandable metal sleeve 11, 11A, 11B extends and is connected thereto.

FIG. 12 shows a downhole repairing system 100 for straddling over a zone 101 downhole in a well 1. The zone may be a production zone which produces too much water, too much sand or other undesired formation fluid, and which therefore needs to be shut off. The production zone is often at least 50-300 metres long, and normal expandable patches cannot be expanded and used as one patch to cover a zone which is 50-300 metres long. In order to seal off such long zones, several tubular sections 3 are assembled into a downhole straddle assembly 2, and thus the tubular sections 3 are mounted end to end in succession to form one tubular pipe 10. The at least two tubular sections 3 of the tubular sections are an expandable metal sleeve 11 having a first end 14 and a second end 15. The tubular pipe 10 of the downhole straddle assembly 100 has a first open end 4 and a second open end 5. The tubular pipe 10 has a first end tubular section 16A forming the first open end 4 of the tubular pipe 10, and a second end tubular section 16B forming the second open end 5 of the tubular pipe. The tubular section mounted to the first end tubular section 16A is a first expandable metal sleeve 11 being more pliant than the first end tubular section 16A, and the tubular section mounted with the second end tubular section 16B is a second expandable metal sleeve 11 being more pliant than the second end tubular section 16B.

Each expandable metal sleeve 11, 3 is arranged between the first tubular section 3, 16 and the second tubular section 3, 17, creating a distance d between the first tubular section and the second tubular section. The distance is equal to the length of the expandable metal sleeve along a longitudinal axis 29 of the straddle assembly 2. The first end 14 of the expandable metal sleeve 11 is connected to the adjacent tubular sections 3 of the tubular sections 3 forming the tubular pipe 10 which in FIG. 12 is the first tubular section 16, and the second end 15 of the expandable metal sleeve 11 is connected to the adjacent tubular sections 3 of the tubular sections 3 forming the tubular pipe 10 which in FIG. 12 is the second tubular section 3, 17.

By connecting the tubular sections, in which the expandable metal sleeve 11 is connected end-to-end with the adjacent tubular sections forming the downhole straddle assembly and not connecting the expandable metal sleeve on the outer face of the tubular pipe, the inner diameter of the straddle assembly can be made bigger, and thus the inner diameter, e.g. of the production casing, is not reduced as much as in the known solutions. When straddling over a zone in a production well 1, the overall inner diameter of the well is very important as it defines how productive the well can be after the zone has been isolated. The smaller the inner diameter of the straddle assembly, the smaller the resulting flow area of the well 1. Thus, the expandable metal sleeve has an inner sleeve face 18 forming part of an inner straddle face 21 of the downhole straddle assembly 2, and the expandable metal sleeve has an inner sleeve diameter $ID_e$ which is equal to or larger than an inner diameter $ID_s$ of the tubular sections in the unexpanded condition of the expandable metal sleeve. Hereby, the inner straddle diameter is increased in relation to prior art straddle assemblies.

Since it is only the expandable metal sleeves of the tubular sections which are expanded, the downhole straddle assembly 2 is therefore capable of isolating a very long zone, i.e. a zone which is much longer than 50 metres. Furthermore, by expanding only the expandable metal sleeves 11 of the tubular sections 3, the connections between all the other tubular sections are maintained in an unexpanded sealing condition, providing a reliable solution so that the intended zone isolation/separation is obtained.

The tubular sections 3 have an outer diameter $OD_s$, and the expandable metal sleeve 11 has an outer sleeve diameter $OD_e$ in an unexpanded state which is substantially equal to the outer diameter $OD_s$ of the other tubular sections even though the expandable metal sleeve is more pliant, as shown in FIG. 12. Thus the outer sleeve diameter is equal to or smaller than the outer diameter of the tubular sections, so that the expandable metal sleeve is not damaged while the downhole straddle assembly 2 is run into the borehole 41.

In FIG. 13, the downhole straddle assembly 2 is shown in an expanded state in which the expandable metal sleeve of the tubular pipe 10 is expanded, and the straddle assembly is thus set straddling over the zone 101 and the downhole straddle assembly 2 thus seals off the entire zone 101, so that fluid from the zone is no longer produced in the well 1. The downhole straddle assembly has the inner straddle face 21 forming a flow path 22 in the straddle assembly and a first open end 4 and a second open end 5, so that fluid from other zones are still flowing through the downhole straddle assembly and further up to the top of the well. The expandable metal sleeve 11 is more pliant and more easily expanded than the other tubular sections 3, so that the expandable metal sleeve is expanded without expanding the first tubular section 16 and the second tubular section 17 of the tubular pipe 10. The expandable metal sleeve 11 is thus made of a metal material having a lower yield strength than the adjacent tubular sections 16, 17. The adjacent tubular sections 16, 17 are also made of metal and the downhole straddle assembly is made predominantly of metal.

In FIGS. 12 and 13, the ends 4, 5 of the expandable metal sleeve are welded to the first tubular section and the second tubular section. In FIG. 14, the ends of the expandable metal sleeve are mainly threadingly connected to the first tubular section 16 by thread 43 and further connected by a weld connection 44. The tubular sections 16, 17 have end parts 6 having a decreased thickness and the end parts are at least partly overlapping the ends of the expandable metal sleeve. A portion 42 of the end parts 6 of the first tubular section 3, 16 overlaps the expandable metal sleeve 3, 11 functioning as a restriction to prevent free expansion of the expandable metal sleeve and thus to prevent that the expandable metal sleeve is thinning to such an extent during the expansion process that the expandable metal sleeve loses its sealing properties when sealing against the inner wall 45 of the borehole 41 (shown in FIG. 13). Thus, the tubular sections 16, 17 have a part thickness $t_p$, which is larger than a thickness $t_e$ of the expandable metal sleeve.

In FIG. 12, a plurality of tubular sections 3 is arranged end-to-end in succession of each other to form a tubular pipe 10. In FIGS. 15-16, some of these tubular sections 3 comprise other completion components. In FIG. 15, one tubular section comprises an inflow section 7 having a screen 12 opposite an opening 38. The straddle assembly 2 in FIG. 15 is thus used to insert a screen 12 opposite a zone 101, which e.g. produces too much sand. In another embodiment, one tubular section may comprise a sensor section 8 for measuring a property of the formation fluid, e.g. pressure or temperature. When operating in openhole parts of the well, inserting a sensor section into the wall of the borehole may be very difficult, and therefore a downhole straddle assembly can be used for such purpose. In FIG. 16, several of the tubular sections comprise a gas lift valve 9 for providing gas lift into part of the well in order for the well to be self-producing again.

In FIG. 16, the downhole straddle system 100 is inserted into a well tubular metal structure 30, and the downhole straddle assembly 2 is expanded and left in the well. The downhole straddle assembly 2 may thus be used to seal off a damaged zone in the well tubular metal structure and thus strengthen that part of the well tubular metal structure if it is about to collapse, or re-establish the production zone by inserting a new inflow section or gas lift valves as shown. The expandable metal sleeves 11 are expanded to seal against the wall 31 of the well tubular metal structure, so that an outer face 19 of the expandable metal sleeve faces abuts the inner face 32 of the wall 31 of the well tubular metal structure after expansion. Thus, the downhole straddle assembly 2 may be arranged opposite a zone 101 having a damaged valve which can no longer close or opposite the openings or perforations in the well tubular metal structure, and the expandable metal sleeve of the straddle assembly is expanded on either side of the valve or openings/perforations.

In FIG. 17, the expandable metal sleeve 11 of the tubular pipe 10 comprises a sealing arrangement 47 provided in a groove 46 formed by projections 51 in order to provide a very reliable seal against the inner face of the well tubular metal structure or the borehole. The sealing arrangement 47 comprises a circumferential sealing element 48 and a circumferential resilient element 49. The circumferential sealing element 48 encloses with the groove a space in which the circumferential resilient element 49 is arranged. During expansion of the expandable metal sleeve 11, a portion of the circumferential sealing element 48 is pressed radially inwards when abutting the inner face of the borehole or the well tubular metal structure, so that the circumferential resilient element 49 is squeezed between the portion and the groove, thereby increasing the longitudinal extension of the circumferential resilient element 49. After the expansion of the expandable metal sleeve 11, the residual stresses cause the expandable metal sleeve 11 to spring back towards its original position and thus to a somewhat smaller outer diameter. When this happens, the circumferential resilient element 49 will also partly, if not entirely, return to its original position, and thus press the portion of the circumferential sealing element 48 towards the inner face of the borehole or well tubular metal structure, maintaining the sealing effect of the circumferential sealing element 48.

In FIG. 18, the expandable metal sleeve 11 of the tubular pipe 10 comprises another sealing arrangement 47 and circumferential rings 28 arranged circumferenting the expandable metal sleeve 11, so that when expanded the expandable metal sleeve becomes corrugated thus strengthening the collapse rating of the expandable metal sleeve. The sealing arrangement comprises a sealing sleeve 27 arranged between two circumferential rings 28. The sealing sleeve 27 has a corrugated shape forming a groove in which a sealing element 48 of e.g. elastomer or rubber is arranged. The sealing sleeve 16 has an opening 17*b* providing fluid communication between the annular space surrounding the expandable metal sleeve and a space 23*b* under the sealing sleeve 27. Thus when the pressure increases in the annular space, the space 23*b* is exposed to the same pressure, and thus the pressure across the sealing element is equalised.

FIG. 19 shows part of downhole straddle assembly having an expandable metal sleeve 11 and a first end part 206 and a second end part 209 for mounting the expandable metal sleeve to other tubular sections 3 of the downhole straddle assembly 2. Tubular sections of the downhole straddle assembly 2 are illustrated by dotted lines in FIG. 19. The expandable metal sleeve 2 is shown in its unexpanded condition, and in order to provide zonal isolation, the expandable metal sleeve is expanded to a larger outer diameter by a hydraulic pressure from within to plastically deform the expandable metal sleeve until the outer face presses towards the wall of the borehole. The first end part 206 has a first end 207 connected to the first end of the expandable metal sleeve and a second end 208 for being mounted as part of the tubular pipe 10, and the second end part 209 has a first end 210 connected to the second end of the expandable metal sleeve and a second end 211 for being mounted as part of the tubular pipe 10. The first end 207 of the first end part 206 is connected "end-to-end" to the first end 3 of the expandable metal sleeve, and the first end 210 of the second end part 209 is connected "end-to-end" to the second end 4 of the expandable metal sleeve, so that they form one tubular pipe 10. Thus, there is no base pipe within the expandable metal sleeve along an entire length L (shown in FIG. 21) of the expandable metal sleeve, and the downhole straddle assembly is therefore "base-less". The second ends 208, 211 of the end parts are provided with an external thread (male thread connection) 20*b* or an internal thread (female thread connection) 20*b* for being mounted to corresponding external or internal threads of the well tubular metal structure.

In small diameter wells, the expandable metal sleeve does not need to expand as much as in larger diameter wells/boreholes, and therefore it is possible for the expandable metal sleeve of the "base-less" annular barrier to maintain the barrier function without the base pipe.

Furthermore, the circumferential projections 227 increase the strength of the expanded expandable metal sleeve 2 when the expandable metal sleeve is not expanded more than required in small diameter wells/boreholes, so that the expandable metal sleeve can serve as both the base pipe and the barrier.

In FIG. 19, the second end 208 of the first end part 206 is provided with a female thread connection, i.e. an internal thread, and the second end 211 of the second end part 209 is provided with a male thread connection, i.e. an external thread. The first and second end parts 206, 209 are connected to the first and second ends 3, 4 of the expandable metal sleeve 2 by means of a standard connection 14, such as a stub acme thread connection as shown. The first and second ends 3, 4 of the expandable metal sleeve 2 are provided with external threads matching internal threads of the first end part 206 and the second end part 209, the internal and external threads forming the stub acme thread connections. Other standard connections within the oil industry can be used. Sealing elements 48 are arranged in grooves 16 on the outer face of the expandable metal sleeve 2 for increasing the sealing ability to the wall of the borehole when expanded downhole. The grooves 16 may be provided by the circumferential projections 227, and when expanding the expandable metal sleeve, the first section between the projections bulges more radially outwards than the projections, forcing the sealing element 48 radially outwards. The expandable metal sleeve 2 has an outer sleeve diameter $Od_e$ in an unexpanded state, the unexpanded outer sleeve diameter being equal to or slightly smaller than an outer diameter $OD_P$ of the first and second end parts, so that the end parts protect the sealing elements while run in hole.

In FIG. 20, the downhole repairing system 100 has a first outer diameter $OD_{w1}$, and in FIG. 20 the downhole repairing system 100 has a second outer diameter $OD_{w2}$ which is smaller than the first outer diameter. If during running the downhole repairing system in the small diameter borehole, circulation of fluid is poor due to an unexpected narrowing of the borehole, the downhole repairing system can then be retracted, and part of a plurality of tubular sections of the downhole straddle assembly can be dismounted and replaced with tubular sections having a smaller outer diameter $OD_{w2}$, as shown in FIG. 20. This can easily be performed by replacing the first and second end parts 206, 209 with other first and second end parts of a smaller outer diameter at the thread connections, and mounting other tubular sections having a smaller outer diameter. Thus, by having disconnectable end parts 206, 209, the end parts 6, 9 can easily be replaced with other end parts matching smaller (or larger) outer diameter tubular sections, so that reducing the outer diameter of the downhole repairing system at certain sections to increase circulation in a certain area is possible.

As shown in FIG. 20, the first and second end parts 206, 209 are tubular and have a maximum wall thickness $T_{P1}$ which is larger than a maximum wall thickness $T_2$ of the expandable metal sleeve 2.

In FIG. 21, the expandable metal sleeve is connected to other end parts 206, 209 and the sealing elements 48 are arranged in grooves of the expandable metal sleeve.

As shown in FIG. 22, the downhole straddle assembly may have several expandable metal sleeves, so that the downhole straddle assembly straddling over a damaged zone is supported by the intermediate expandable metal sleeve, so that the downhole straddle assembly does not bend or bulge along the zone over which it straddles. Alternatively, the downhole straddle assembly may straddle over two damaged or water producing zones, i.e. a first zone 101 and a second zone 102.

The expandable metal sleeve is made of a material which is more pliant than the material of the first and second end parts, the first end tubular section, the second end tubular section, and the other tubular sections 3. In order to determine if the material of the expandable metal sleeve is more pliant and thus easier to elongate than the material of the first and second end parts, the test standard ASTM D1457 can be used.

A downhole setting tool string may comprise a stroking tool being a tool providing an axial force for pressurising the straddle assembly. The stroking tool may comprise an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid, reservoir fluid, formation fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole repairing system for repairing a zone of a downhole well having a top and an axial axis, comprising:

a downhole straddle assembly for straddling over the zone downhole in the well, the straddle assembly comprising:

a plurality of tubular sections mounted end to end in succession to form one tubular pipe having a first end tubular section nearest the top forming a first open end of the tubular pipe, and having a second end tubular section forming a second open end of the tubular pipe, the first end tubular section having a first end inner diameter and the second end tubular section having a second end inner diameter, wherein the tubular section mounted to the first end tubular section is a first expandable metal sleeve being more pliant than the first end tubular section, and the tubular section mounted to the second end tubular section is a second expandable metal sleeve being more pliant than the second end tubular section, and a downhole setting tool string comprising a tubular tool part being arranged in the tubular pipe of the downhole straddle assembly and having expansion openings for allowing pressurised fluid from the downhole setting tool string to flow out of the expansion openings to expand the expandable metal sleeves, the tubular tool part having a first tool part with a first outer tool diameter arranged opposite the first end tubular section and a second tool part with a second outer tool diameter arranged opposite the second end tubular section, wherein the first end tubular section has a groove for receiving at least one retractable engagement part of a connection tool of the downhole setting tool string, and the second outer tool diameter is smaller than the second end inner diameter creating a first distance which is less than 2 mm, and wherein at least one sealing element is arranged in the distance.

2. The downhole repairing system according to claim 1, wherein the connection tool mechanically locks the first end tubular section along the axial axis.

3. The downhole repairing system according to claim 1, wherein the connection tool comprises a mandrel for providing a radial force outwardly on the at least one retractable engagement part.

4. The downhole repairing system according to claim 3, wherein the mandrel is moved to be offset in relation to the at least one retractable engagement part, so that the at least one retractable engagement part can move radially inwards and disengage from the first end tubular section.

5. The downhole repairing system according to claim 1, wherein the at least one retractable engagement part is retracted by means of the pressurised fluid.

6. The downhole repairing system according to claim 1, wherein the at least one retractable engagement part is connected with a piston sleeve which is moved upwards or downwards along the axial axis to disengage the at least one retractable engagement part from the first end tubular section.

7. The downhole repairing system according to claim 1, wherein the connection tool comprises a breakable element for maintaining the at least one retractable engagement part in engagement with the groove until a predetermined force is reached.

8. The downhole repairing system according to claim 1, wherein the second end tubular section has a one-way valve allowing fluid from the well to enter the downhole setting tool string and preventing fluid from the downhole setting tool string from entering the well.

9. The downhole repairing system according to claim 1, wherein the second tool part is closable by means of a ball being dropped into the tubular tool part.

10. The downhole repairing system according to claim 1, wherein the first outer tool diameter is smaller than the first end inner diameter, creating a second distance which is less than 4 mm and/or equal to the first distance, and wherein at least one sealing means is arranged in the second distance.

11. The downhole repairing system according to claim 1, wherein the downhole setting tool string comprises coiled tubing, a workover pipe or a drill pipe connected to the connection tool for providing pressurised fluid to expand the expandable metal sleeves.

12. The downhole repairing system according to claim 1, wherein the downhole setting tool string comprises a pump and a motor for driving the pump, the motor being powered through a wireline, so that the downhole setting tool string is a wireline setting tool string.

13. The downhole repairing system according to claim 1, wherein the downhole straddle assembly is only mechanically locked along the axial axis at the first end tubular section.

14. A repairing method for straddling over a zone which is a collapsed part of a borehole, a damaged production zone or a water producing zone, the method comprising:

providing the downhole repairing system according to the downhole repairing system according to claim 1, inserting the downhole repairing system into a borehole or a well tubular metal structure, providing the downhole repairing system opposite the zone to be sealed off, closing the second tool part, pressurising the inside of the tubular tool part, expanding the expandable metal sleeves on either sides of the zone, disconnecting the at least one retractable engagement part from the groove, and pulling the tool string out of the well.

15. The repairing method according to claim 14, in which providing the downhole repairing system comprises arranging the tool string inside the downhole straddle assembly, and engaging the at least one retractable engagement part with the groove of the first end tubular section.

16. The repairing method according to claim 14, in which engaging the at least one retractable engagement part with the groove is performed by moving a mandrel to be opposite the at least one retractable engagement part, so that the mandrel pushes the at least one retractable engagement part radially outwards.

* * * * *